United States Patent [19]

Townsend et al.

[11] 3,946,577

[45] Mar. 30, 1976

[54] METHOD OF KNITTING AN ELASTICISED WELT

[75] Inventors: Keith Gerald Townsend, Aylestone; Frederick Keel, Narborough, both of England

[73] Assignee: The Bentley Engineering Co. Ltd., England

[22] Filed: Apr. 16, 1973

[21] Appl. No.: 351,585

[30] Foreign Application Priority Data

Apr. 18, 1972 United Kingdom ..... 17815/72

[52] U.S. Cl. ..... 66/14; 66/172 E; 66/173

[51] Int. Cl.[2] .... D04B 9/10; D04B 9/24; D04B 9/54

[58] Field of Search ..... 66/172 R, 172 E, 14, 173

[56] References Cited

UNITED STATES PATENTS

| | | | |
|---|---|---|---|
| 2,150,335 | 3/1939 | Miller et al. | 66/173 |
| 2,316,823 | 4/1943 | Thurston | 66/14 |
| 3,402,575 | 9/1968 | Peberdy | 66/14 X |
| 3,606,771 | 9/1971 | Peberdy | 66/133 |

*Primary Examiner*—Wm. Carter Reynolds
*Attorney, Agent, or Firm*—Robert E. Burns; Emmanuel J. Lobato; Bruce L. Adams

[57] ABSTRACT

A method of knitting, on a circular knitting machine, a succession of tubular articles such as socks or stockings, each having an elasticized roll welt having an elastic yarn laid therein, wherein a leading end of the elastic yarn is temporarily anchored in knitted stitches of each completed article and thereafter the elastic yarn is laid within the welt fold of the next succeeding article.

6 Claims, 2 Drawing Figures

METHOD OF KNITTING AN ELASTICISED WELT

The invention relates to a method of knitting on circular knitting machines, particularly but not exclusively those of the superposed needle cylinder type in which double headed needles are transferable between the cylinders for the purpose of making ribbed fabric. The invention also relates to articles made by such a method, particularly articles of hosiery such as stockings, socks and pantie-hose.

An important feature of hosiery knitted on double cylinder machines is the roll-welt which is constructed on needles arranged in a rib relationship, generally a 1/1 relationship, i.e. alternate needles in the lower cylinder and intermediate needles in the upper cylinder. Yarn is fed to the needles at a knitting station so that it extends in a zig-zag fashion between the upper and lower needles. The upper cylinder needles are maintained in a high inactive track while the lower cylinder needles continue to knit about four courses and the welt is completed by causing all of the needles to knit for a further course. It is an object of the invention to incorporate an elastic yarn in the roll-welt to form an elasticized welt.

The invention provides a method of knitting, on a circular knitting machine, a succession of tubular articles each having an elasticized roll-welt. Each article on completion is pressed off from the needles, but before the pressing off is completed an elastic yarn is knitted into a portion of the final course of the completed article and the setting up of a fresh course is commenced for knitting a roll-welt to start the next succeeding article. The elastic yarn is thus laid into the roll-welt of the succeeding article as it is set up and knitted. The laying in of the elastic yarn should commence before the previous article is completely pressed off and the elastic yarn may be temporarily retained by passing it behind the stems of one or more needles positioned at clearing height. The final anchorage of the leading end of the elastic yarn may be effected after its release from the final knitted stitches of the preceding article by knitting it into the first stitches of the succeeding article. Thus a leading end of the elastic yarn is temporarily anchored in knitted stitches of each completed article and thereafter the elastic yarn is laid within the welt fold of the next succeeding article.

One example of an elastic yarn that may be used in the method of the invention is a rubber yarn. Other elastic yarns may, however, be used.

The method of the invention is particularly suited to the formation of elasticized welts on a succession of articles knitted and automatically separated from one another by the method described in U.S. Pat. No. 3,402,575.

Figure 1:
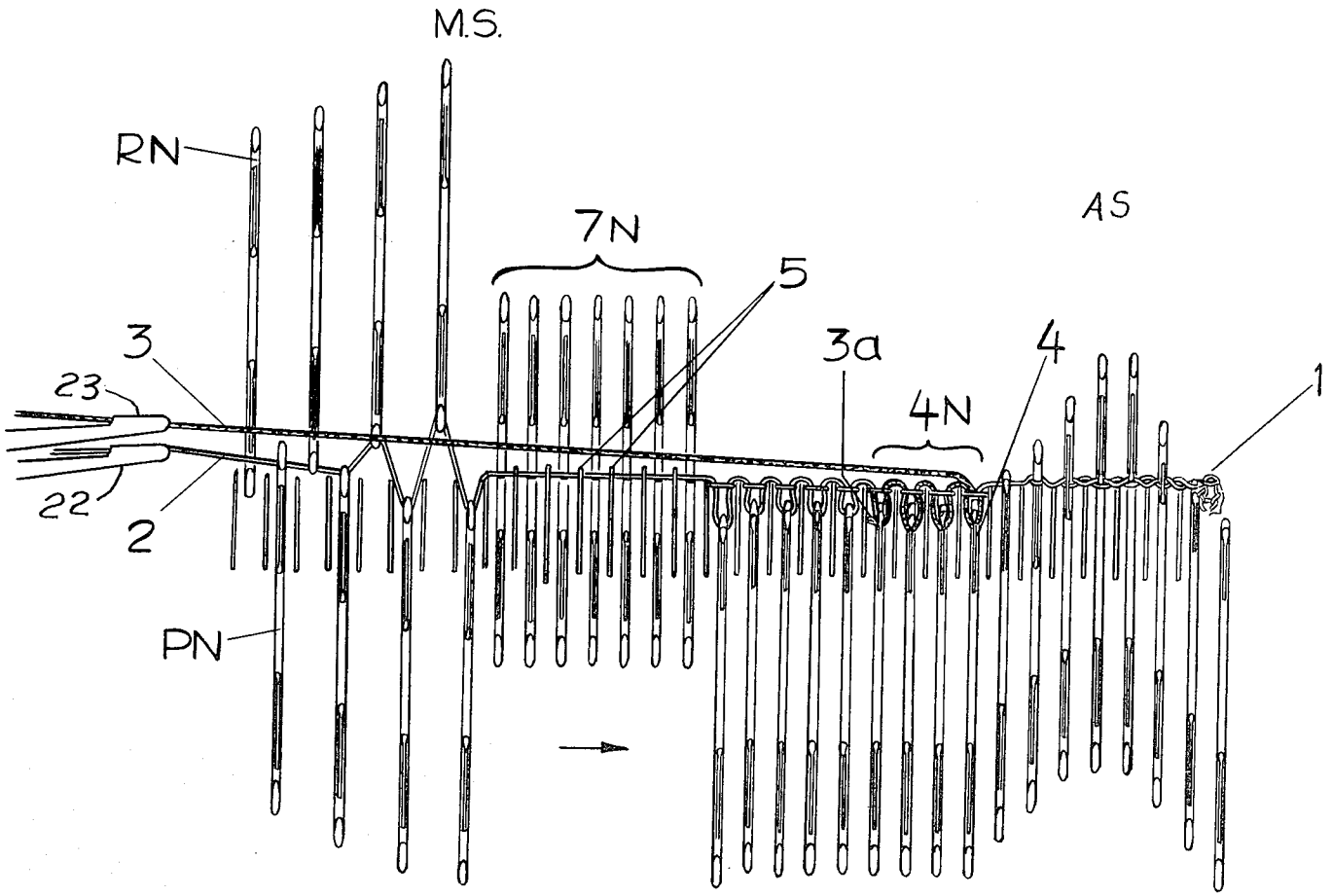
Figure 2:
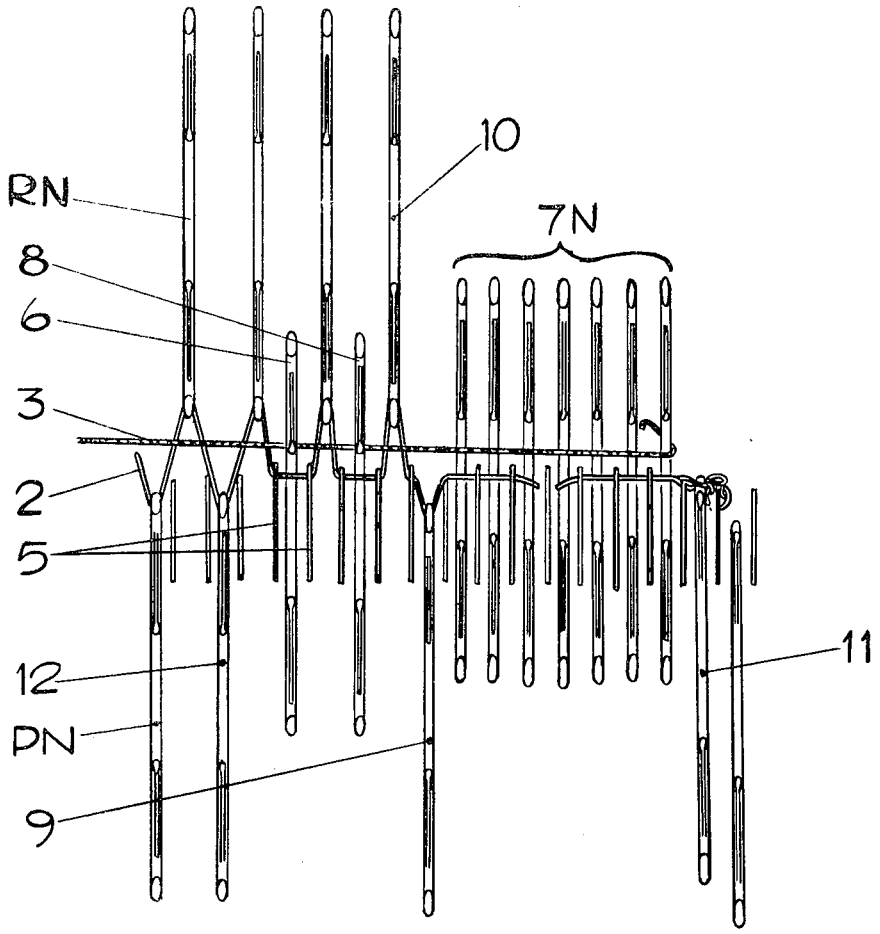

The invention is hereinafter described, by way of example only, as being performed on a knitting machine of the opposed coaxial cylinder type. The following description makes reference to the accompanying drawings in which: FIGS. 1 and 2 are schematic developed views of minor arcs of needles on such a knitting machine at different stages of the knitting cycle.

At the final stage of knitting a sock or stocking on a double cylinder machine, when the final stitches of the toe portion are being formed on the full complement of needles all of which are in the bottom cylinder, pressing off the completed article and knitting an elasticized roll-welt of the next article preferably proceeds as follows.

While the supply of main or ground yarn is continued at the main knitting station and all needles are knitting normally at this station, a bolt cam is inserted at an auxiliary knitting station to cause the needles to be lowered in the usual stitch forming motion. However, no yarn is introduced at the auxiliary station and therefore the needles 'press off' their loops and travel around, devoid of yarn, towards the main knitting station. Before they reach the main knitting station the first group of needles that are devoid of yarn are raised above the normal clearing height and the subsequent needles are divided into a 1/1 set out by alternate needles being transferred to the upper cylinder. The group of needles raised above the normal clearing height generally comprises about seven needles, but the choice of an appropriate number of needles forming this group depends on the characteristics of the ground yarn as is apparent from the ensuing description.

The situation which prevails at the moment that the first empty needle (the first needle of the abovementioned group) approaches the main feeding station is that the previously knitted article is held only by those needles which extend in advance of this first empty needle through the main knitting station and up to the auxiliary station at which the needles are shedding their stitches. At this point, and before the group of empty needles raised above the normal clearing height enter the main knitting station, an elastic yarn is fed together with the ground yarn so that the elastic and ground yarns are together formed into loops at the main knitting station. When the group of empty needles above the normal clearing height pass through the main station they are not diverted down the feed and stitch cams and therefore both the main yarn and the elastic yarn are laid across and in front of the stems of this group of needles. The empty needles following this group through the main knitting station have been divided into a 1/1 set out as described previously, and because of the relative positions of the elastic and ground yarn feeders, these needles take only the ground yarn at the main knitting station. The yarn is taken in the hooks of the alternating bottom and top cylinder needles and thus extends in zig-zag fashion between the plain and rib needles. The elastic yarn is laid in front of this zig-zag barrier of yarn as the needles move through the main knitting station.

This stage of the knitting cycle is illustrated in FIG. 1.

After passing through the main knitting station the first one or few bottom cylinder (plain) needles following the group are kept in a low non-knitting position, while the following two or more bottom cylinder needles rise to normal clearing height. The upper cylinder (rib) needles are kept in a non-knitting position and not cleared, as is usual in the formation of a roll-welt. By virtue of the low position of the first bottom cylinder needle or needles following the group and the high position of the upper cylinder needles, the elastic yarn that is laid over the zig-zag barrier of ground yarn is now laid sufficiently inwards of the needle circle, following the low bottom cylinder needle or needles, that the bottom cylinder needles that are raised to clearing height move in front of the elastic yarn and thus retain it. None of the subsequent needles are moved to clearing height after the main knitting station but are allowed to remain in the welt tracks or float tracks of the upper and lower cylinders.

This stage of the knitting cycle is illustrated in FIG. 2.

While the above procedure is taking place at the main knitting station the remaining stitches of the previous article, including the stitches of elastic yarn, are being shed at the auxiliary station. As the group of needles above the normal clearing height, which needles have the ground yarn and elastic yarn laid across their stems, passes the sinker knock-over position (after the main knitting station) the sinkers move inwards and press on the short length of ground yarn and break it across the stems of the needles in the manner described in U.S. Pat. No. 3,402,575. The elastic yarn which is laid at a slightly higher level is not taken by the sinkers and remains across the group of needles as they approach the auxiliary knitting station.

The number of needles in the group of needles that are raised to above clearing height should be chosen so that the trailing end of the yarn attached to the previously knitted article and the leading end of the yarn forming the set up row of the succeeding article are securely anchored by the sinkers between the main knitting station and the auxiliary knitting station. If the yarn is to be severed by snapping, there must be sufficient needles in the group to ensure that the sinkers between the needles snap the yarn, as fully described in U.S. Pat. No. 3,402,575.

When the needles which hold the last stitches of the previous article, and also the first loops of elastic yarn, pass down the auxiliary stitch cams, as no yarn is being fed at this station, the previous article is cast off the needles and, due to the severing of the main yarn by the sinkers, this article is taken from the machine by air suction. During the release of the stitches from the last needles, the leading end of the elastic yarn is also released and unravels from the previously knitted article. The elastic yarn would, if not retained by the lower cylinder needles that are raised to clearing height, whip back and be released from the first loops of the welt of the new article. Because the elastic yarn is thus retained, its end is drawn inwards by air suction between the needle cylinders around the stem of the leading needle of the group above normal clearing height. The severed end of main yarn which constitutes the leading end of yarn for knitting the new article is held by the sinkers between the last few needles of the group as they approach the auxiliary station.

As the group of needles at above normal clearing height passes the auxiliary knitting station the auxiliary feed cam is displaced to an inoperative position so that the needles at clearing height which follow the group and which retain the elastic yarn are allowed to maintain their cleared position. The uncleared needles in a 1/1 set out pass the auxiliary station in the inactive position which is normal while making a roll-welt.

As the group of needles above normal clearing height with the leading end of elastic yarn laid across their stems continue beyond the auxiliary knitting station they eventually reach the transfer station where alternate needles of the group are transferred to the upper cylinder to complete the 1/1 set out of the whole circle of needles. As this group of needles (now in a 1/1 set out) with the elastic yarn across the needle stems approaches the main knitting station the upper cylinder needles are raised and the lower cylinder needles are lowered with their latches held open by latch guards so that the elastic yarn is positioned behind the needle latches which are maintained open by the latchguard. The elastic yarn is thus disposed in a zig-zag fashion between the open latches of the rib and plain needles of the group and this action robs the leading end of the elastic yarn which extended beyond the group.

At the main knitting station the upper cylinder needles of the group pass up the rib stitch cam and the lower cylinder needles of the group pass down the main stitch cam so that all needles of the group take the ground yarn in their hooks and the elastic yarn is then 'knocked over', the ground yarn being drawn in loops through the elastic yarn to form the first few completed stitches of the welt of the new article. Thereafter the upper cylinder rib needles following the group pass the main feeding station in the high welt track where they hold their first loops of the new article while the lower cylinder plain needles knit, and the elastic yarn is laid into the welt fold during the four courses of the welt.

At the completion of the welt, the upper cylinder needles are caused to knit together with the lower cylinder needles to close the welt fold and the elastic yarn may then be terminated or allowed to be 'laid in' between the 1/1 stitches of the top of the article as the case may be.

The elastic yarn is thus initially temporarily anchored in knitted stitches of the preceding article, then retained against whipping back on release from the preceding article by means of non-knitting needles of the set-up course, and is finally anchored in knitted stitches of the first course of the roll-welt. It is accordingly laid into the fold of the roll-welt as it is set up and knitted.

The accompanying drawings illustrated the above knitting procedure on a double cylinder knitting machine which has a main knitting station M.S. and an auxiliary knitting station A.S. separated by an arc of about 18 needles. A ground yarn 2 is fed by a feed finger 22 and an elastic yarn 3 is fed by a feed finger 23 which, as is known and is illustrated for example in U.S. Pat. No. 3,606,771, is movable between (1) an inactive position, (2) a yarn introducing position and (3) a normal feeding position. In FIG. 1 needles passing through the auxiliary knitting station A.S. are shedding their stitches as at 1. At the main knitting station M.S. needles which have been divided into a 1/1 set out of rib and plain needles RN and PN, respectively, are operating through part of a knitting cycle to draw the ground yarn 2 into a zig-zag formation. The elastic yarn 3 a tail end **3*a* of which has previously been held by a trapper (not shown), has been fed at the main knitting station M.S. to a needle 4, by movement of the elastic yarn feed finger 23 from its inactive position to the introducing position with synchronous release of the tail end 3a of the elastic yarn 3 from the trapper. The needle 4 is located nine needles in advance of the group of empty needles 7N that are raised to above the normal clearing height, and FIG. 1 shows the first loop of the elastic yarn about to enter the auxiliary knitting station A.S. where it will be pressed off. The tail end 3*a* of the elastic yarn 3, released from its trapper (not shown) immediately the elastic yarn was introduced, is shown knitted with the ground yarn on four needles 4N. During the knitting of the tail end 3*a*, the feed finger for the elastic yarn 3 is in the introducing position which is located past the main knitting station M.S. so that only the tail end 3a is taken by the needles. At the stage shown in FIG. 1 the elastic yarn feed finger 23, is in its normal feeding position which is displaced outwardly from the needle circle so that the elastic yarn is not taken by needles at the main knitting station M.S., or by the sinkers 5 immediately following the main knitting station, so that the elastic yarn 3 floats over the nine needles in advance of the group 7N and is laid over the stems of the needles of the group 7N. The elastic yarn 3** is thus not drawn into a zig-zag formation with the ground yarn at the main knitting station M.S. and as the cylinders turn it is laid against the zig-zag barrier of ground yarn slightly inside the circle of needles.

FIG. 2 shows the stage of the knitting cycle at which the group of needles 7N has moved further past the main knitting station M.S. The sinkers 5 have drawn the ground yarn 2 around the stems of the needles in the group and have thus severed the ground yarn. The first needle to follow the group 7N is designated 9 and is a plain needle that is maintained in a low position after the main knitting station M.S. The next two plain needles of the 1/1 set out are designated 8 and 6 respectively and are raised to clearing height. Because the elastic yarn 3 tends to form a chord across the needle circle as it passes above the plain needle 9 and below the first rib needle 10, it lies behind needles 6 and 8 enabling these needles, as they are raised to clearing height, to pass in front of the elastic yarn and lock it. Thus, when the needle cylinders have rotated to a position such that the elastic yarn 3 is released from the preceding article it will be prevented from whipping back by the retaining action of the needles 6 and 8.

Especially on certain gauges of knitting machines which have their needles pitched closely together, the first two bottom cylinder needles 9 and 8 following the group 7N may be kept low and the following two bottom cylinder needles may be raised to clearing height in order to lock the elastic yarn. This may be necessary to ensure that the elastic yarn lies behind the needles that are raised to clearing height.

What we claim is:

1. A method of knitting, on a circular knitting machine having first and second knitting stations at which needles of the machine can be actuated in the knitting mode, a succession of tubular articles each having an elasticized roll-welt, comprising the following steps:

a. knitting an article with ground yarn on the knitting machine;

b. on completion of the article, pressing-off the article from the needles of the machine at the second knitting station;

c. before the pressing off is completed, knitting an end of an elastic yarn into a portion of the final course of the article at the first knitting station;

d. before the end of elastic yarn is pressed-off at the second knitting station, commencing the setting-up of a fresh course for knitting a roll-welt of the next succeeding article; and e. after the pressing-off of the end of the elastic yarn at the second knitting station, temporarily retaining the elastic yarn in position and laying the elastic yarn into the roll-welt of the said next succeeding article as it is set up and knitted at the first knitting station.

2. A method according to claim 1, wherein during the casting off of the final stitches of the completed article the elastic yarn is temporarily retained by passing it behind the stems of one or more needles positioned at clearing height.

3. A method according to claim 1, wherein a leading end of the elastic yarn is finally knitted into the first stitches of the succeeding article.

4. A method according to claim 1, carried out on a knitting machine of the opposed coaxial cylinder type with needles transferable between cylinders.

5. A method according to claim 1, wherein the knitted tubular articles are automatically separated from one another by virtue of the fact that the ground yarn from which the articles are knitted is fractured by being drawn by sinkers against the stems of a number of needles raised above the normal clearing height between those needles casting off the completed article and those needles setting up the fresh course of the succeeding article.

6. A method according to claim 4, wherein at the first knitting station the needles are divided alternately between said cylinders and are operated through a knitting cycle to draw ground yarn into a zig-zag formation and said end of elastic yarn is laid against the zig-zag formation of ground yarn.

* * * * *